US008207463B2

(12) United States Patent
Saito

(10) Patent No.: US 8,207,463 B2
(45) Date of Patent: Jun. 26, 2012

(54) MINIATURE SWITCH

(75) Inventor: Akira Saito, Kawasaki (JP)

(73) Assignee: Nihon Kaiheiki Industrial Company, Ltd. (JP)

( * ) Notice: Subject to any disclaimer, the term of this patent is extended or adjusted under 35 U.S.C. 154(b) by 490 days.

(21) Appl. No.: 12/510,757

(22) Filed: Jul. 28, 2009

(65) Prior Publication Data

US 2010/0025211 A1 Feb. 4, 2010

(30) Foreign Application Priority Data

Jul. 31, 2008 (JP) ..... 2008-197417

(51) Int. Cl.
*H01H 13/00* (2006.01)
*H01H 3/00* (2006.01)

(52) U.S. Cl. ..... 200/339

(58) Field of Classification Search ..... 200/339
See application file for complete search history.

(56) References Cited

U.S. PATENT DOCUMENTS

| | | | | |
|---|---|---|---|---|
| 6,310,308 | B1 * | 10/2001 | Watson et al. | 200/520 |
| 6,344,619 | B1 * | 2/2002 | Yamasaki et al. | 200/6 A |
| 6,621,025 | B2 * | 9/2003 | Yei et al. | 200/315 |
| 7,145,091 | B1 * | 12/2006 | Wang | 200/315 |

FOREIGN PATENT DOCUMENTS

| | | |
|---|---|---|
| JP | 63-6640 | 1/1988 |
| JP | 63-137425 | 9/1988 |
| JP | 64-33133 | 3/1989 |

* cited by examiner

*Primary Examiner* — Renee Luebke
*Assistant Examiner* — Lheiren Mae Caroc
(74) *Attorney, Agent, or Firm* — Bacon & Thomas, PLLC

(57) ABSTRACT

A miniature switch with a switch operating unit having a swinging motion about a fulcrum on the side opposing the pressed side, instead of a spindle in the switch operating unit. The miniature switch includes: a switch operating unit composed of a holder 9 and an operational button 2 fixed to the holder 9; and a switch mechanism unit composed of a printed circuit board 6, a connector 5, and switch elements 7 arranged in a case 4, and coil springs 8 which engage between the switch elements 7 and the holder 9, wherein the switch operating unit and the switch mechanism unit are coupled to each other by a first packing 10 made of a resilient material, and the switch mechanism unit and the switch operating unit are disposed in a housing 1.

8 Claims, 8 Drawing Sheets

(a)

(b)

MINIATURE SWITCH

BACKGROUND OF THE INVENTION

1. Field of the Invention

The present invention relates to a miniature switch, in particular, the miniature switch capable of performing at least a swinging motion, in which the swinging motion of a switch operating unit can be performed using the side opposing the pressed side as a fulcrum instead of providing a spindle in the switch operating unit.

2. Description of the Related Art

The conventional rocker switch which performs swinging operation is provided with a spindle in the central portion of a switch operating unit for allowing a swinging motion, so that the switch operating unit swings about the spindle (Patent Documents 1 to 3 listed below).

[Patent Document 1] Japanese Utility Model Application Publication No. 64-033133

[Patent Document 2] Japanese Utility Model Application Publication No. 63-137425

[Patent Document 3] Japanese Utility Model Application Publication No. 63-006640

As described above, the rocker switch which performs a swinging motion has a spindle serving as a fulcrum of the swinging motion in the central portion of a switch operating unit. Since an operating stroke is short due to the short distance between the spindle and a pressing position, a switching mechanism has been limited to a seesaw type, and other types have not been available.

Although there has been another type of switch having the spindle provided on an end of the switch operating unit, the spindle of this type of the switch is fixed to a housing, so that the switch can be operated only on one side.

Further, since both of the above-described switches have the spindle, the operation of the operational button other than the swinging operation has been impossible.

In view of the above-described problems, the present invention is intended to provide a miniature switch capable of performing the swinging motion of the switch operating unit using the side opposing the pressed side as a fulcrum instead of providing the spindle in the switch operating unit.

SUMMARY OF THE INVENTION

In order to achieve the object described above, the present invention provides the following:

[1] A miniature switch comprising:

a switch operating unit composed of a holder and an operational button fixed to the holder; and a switch mechanism unit composed of a printed circuit board, a connector, and switch elements arranged in a case, and coil springs which engage between the switch elements and the holder, wherein the switch operating unit and the switch mechanism unit are coupled to each other by a packing made of a resilient material, and the switch mechanism unit and the switch operating unit are disposed in a housing.

[2] The miniature switch according to [1] above, wherein the switch elements are each arranged on the left and right sides of the printed circuit board, and wherein, by lowering the operated side of the operational button, a bottom protrusion of the operational button moves away from an inner step of the housing to descend along the inner surface of the housing, while the bottom protrusion of the operational button on the non-operated side of the operational button is supported by the inner step of the housing on the non-operated side of the operational button so as to serve as a fulcrum of a swinging motion of the operational button.

[3] The miniature switch according to [2] above, wherein release of the operation of the operational button causes the switch mechanism unit to return instantaneously owing to the restoring force of the packing made of the resilient material and the coil spring.

[4] The miniature switch according to [1] above, wherein three switch elements are arranged on the printed circuit board, including two switch elements each arranged on the left and right sides operating by the swinging motion of the operational button and the central switch element operating by pressing of the central portion of the operational button.

[5] The miniature switch according to [4] above, wherein, by lowering the operated side of the operational button owing to the swinging motion of the operational button, the bottom protrusion of the operational button moves away from the inner step of the housing to descend along the inner surface of the housing, while the bottom protrusion of the operational button on the non-operated side of the operational button is supported by the inner step of the housing on the non-operated side of the operational button so as to serve as a fulcrum of the swinging motion of the operational button, and wherein, by operating the central portion of the operational button, the bottom protrusions on the left and right sides of the operational button move away from the inner steps of the housing to descend along the inner surface of the housing, such that only the central switch element is pressed down to operate.

[6] The miniature switch according to [5] above, wherein release of the operation of the operational switch causes the switch mechanism unit to return instantaneously.

[7] The miniature switch according to any one of [1] to [6] above, wherein a flat-type display device is arranged on a surface of the operational button.

[8] The miniature switch according to [7] above, wherein the flat-type display device is an organic light-emitting device.

[9] The miniature switch according to [7] above, wherein the flat-type display device is a liquid crystal display device.

DESCRIPTION OF THE PREFERRED EMBODIMENTS

A miniature switch according to the present invention comprises: a switch operating unit composed of a holder and an operational button fixed to the holder; and a switch mechanism unit composed of a printed circuit board, a connector, and switch elements arranged in a case, and coil springs which engage between the switch elements and the holder, wherein the switch operating unit and the switch mechanism unit are coupled to each other by a packing made of a resilient material, and the switch mechanism unit and the switch operating unit are disposed in a housing.

Hereinbelow, the embodiments of the present invention will be described in detail.

Figure 1:
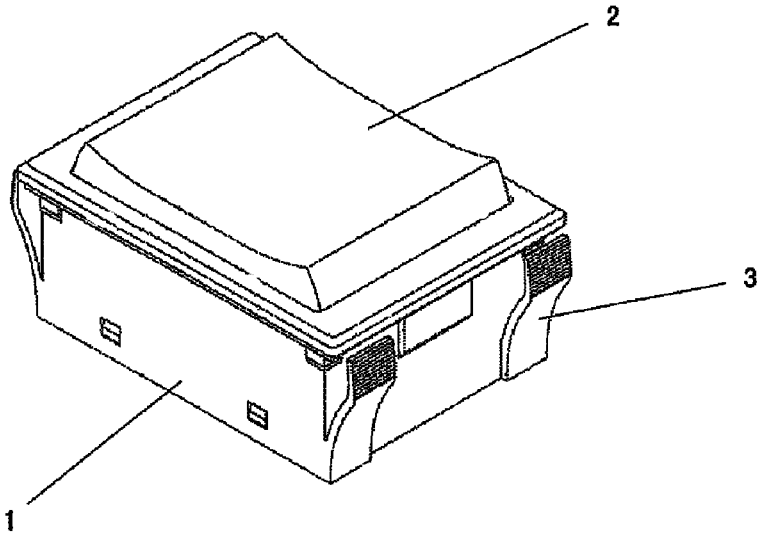
FIG. 1 is a perspective view of a miniature switch illustrating a first embodiment of the present invention.
Figure 2:
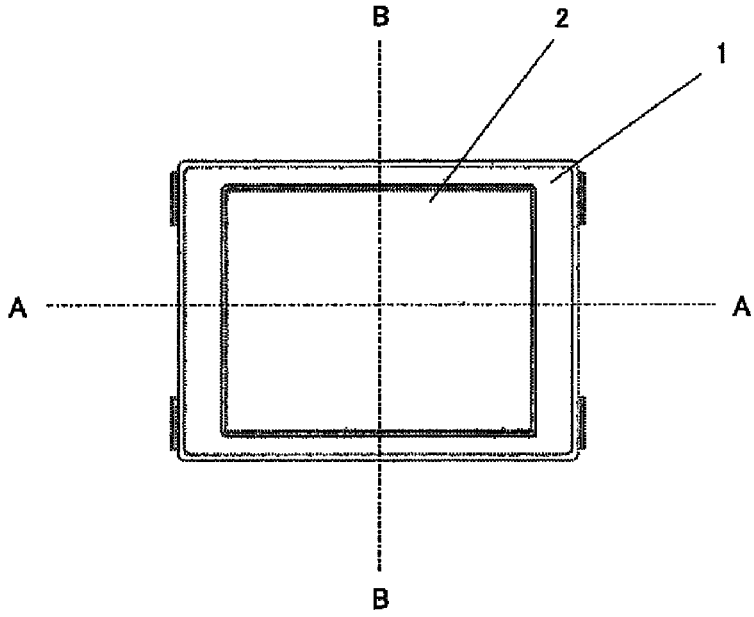
FIG. 2 is a plan view of the miniature switch illustrating the first embodiment of the present invention.
Figure 3:
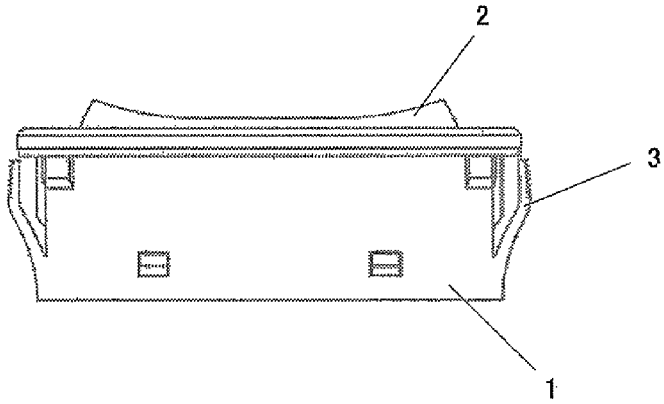
FIG. 3 is a front view of the miniature switch illustrating the first embodiment of the present invention.
Figure 4:
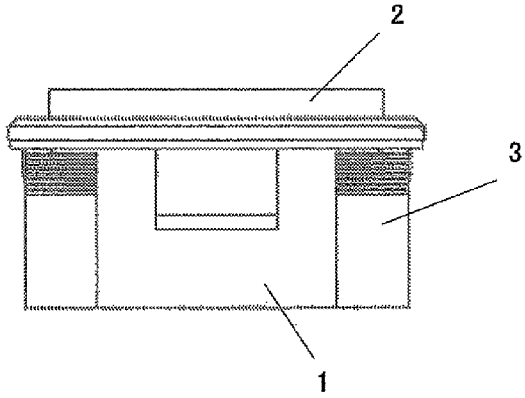
FIG. 4 is a side view of the miniature switch illustrating the first embodiment of the present invention.
Figure 5:
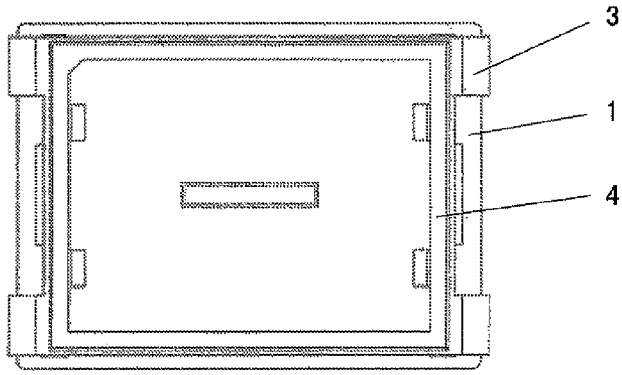
FIG. 5 is a bottom view of the miniature switch illustrating the first embodiment of the present invention.

FIG. 1 is a perspective view of a miniature switch illustrating a first embodiment of the present invention, FIG. 2 is a plan view thereof, FIG. 3 is a front view thereof, FIG. 4 is a side view thereof, and FIG. 5 is a bottom view thereof.

In these figures, reference numeral 1 denotes a housing, 2 an operational button, 3 a leaf spring for fixing the switch, and 4 a case arranged below the housing 1.

Now, the structure of the miniature switch according to the first embodiment of the present invention will be described.

Figure 6:
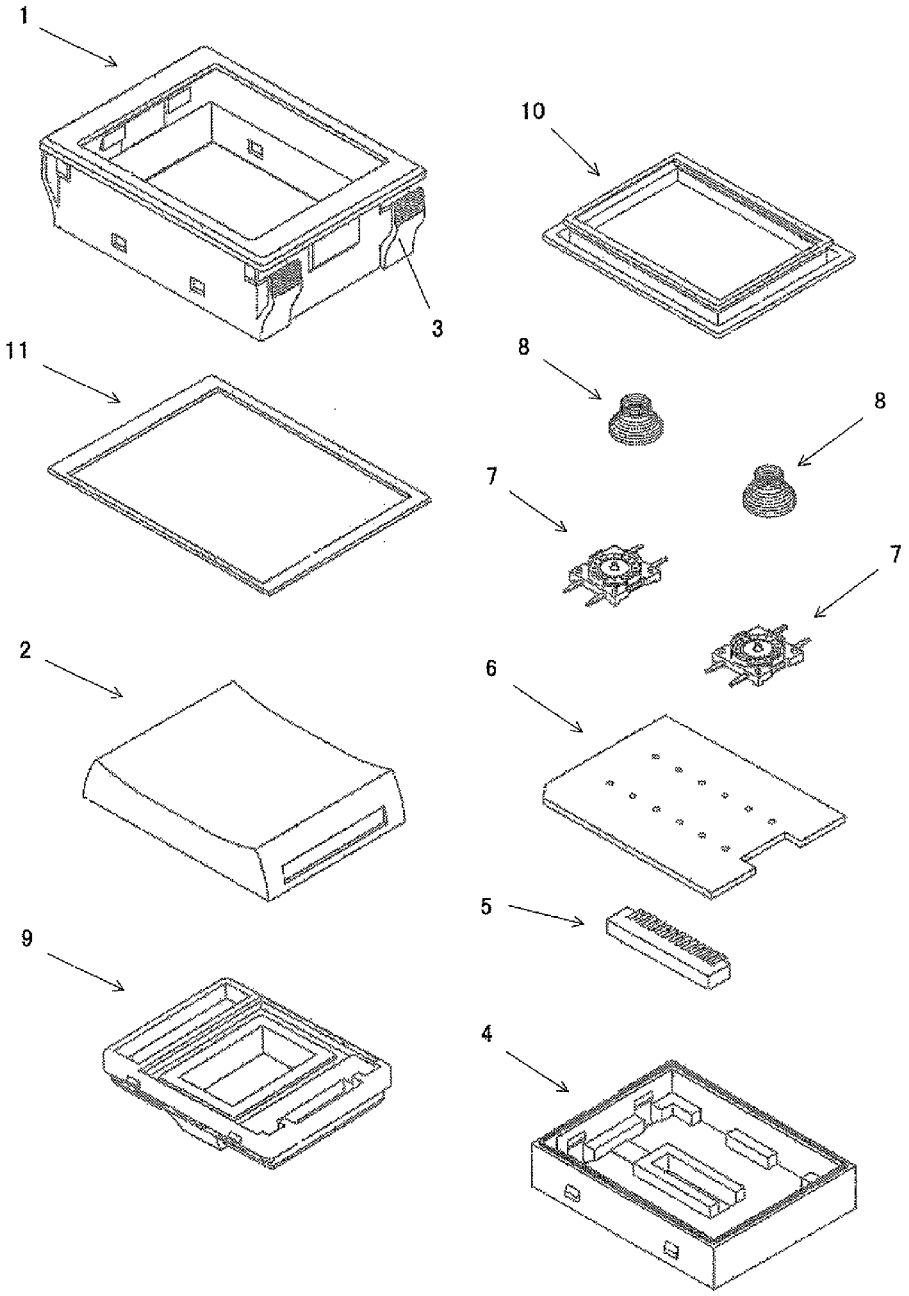
FIG. 6 is an exploded perspective view of the miniature switch illustrating the first embodiment of the present invention.
Figure 7:
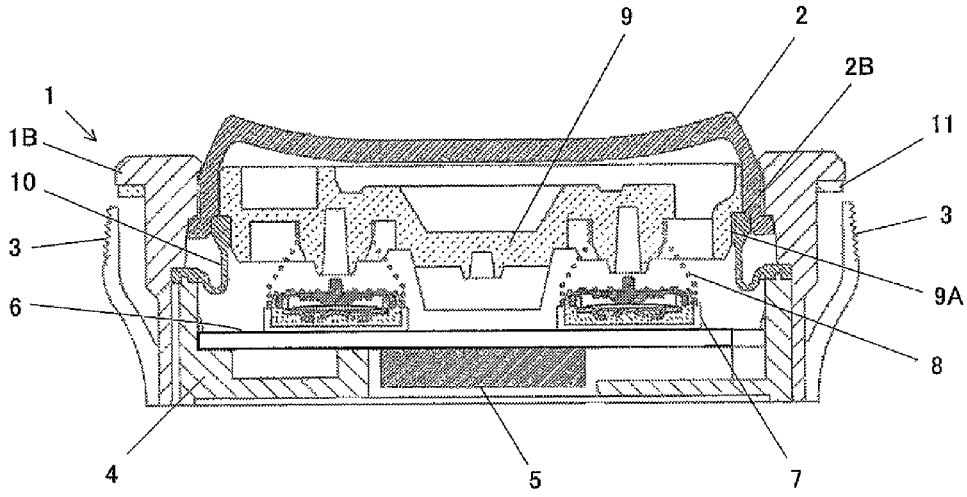
FIG. 7 is a cross-sectional view of the miniature switch illustrating the first embodiment of the present invention, taken along the line A-A in FIG. 2.
Figure 8:
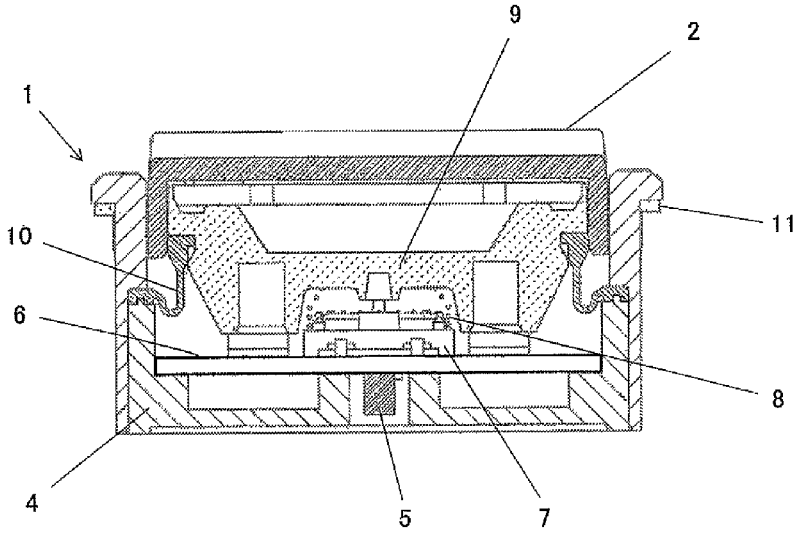
FIG. 8 is a cross-sectional view of the miniature switch illustrating the first embodiment of the present invention, taken along the line B-B in FIG. 2.
Figure 9:
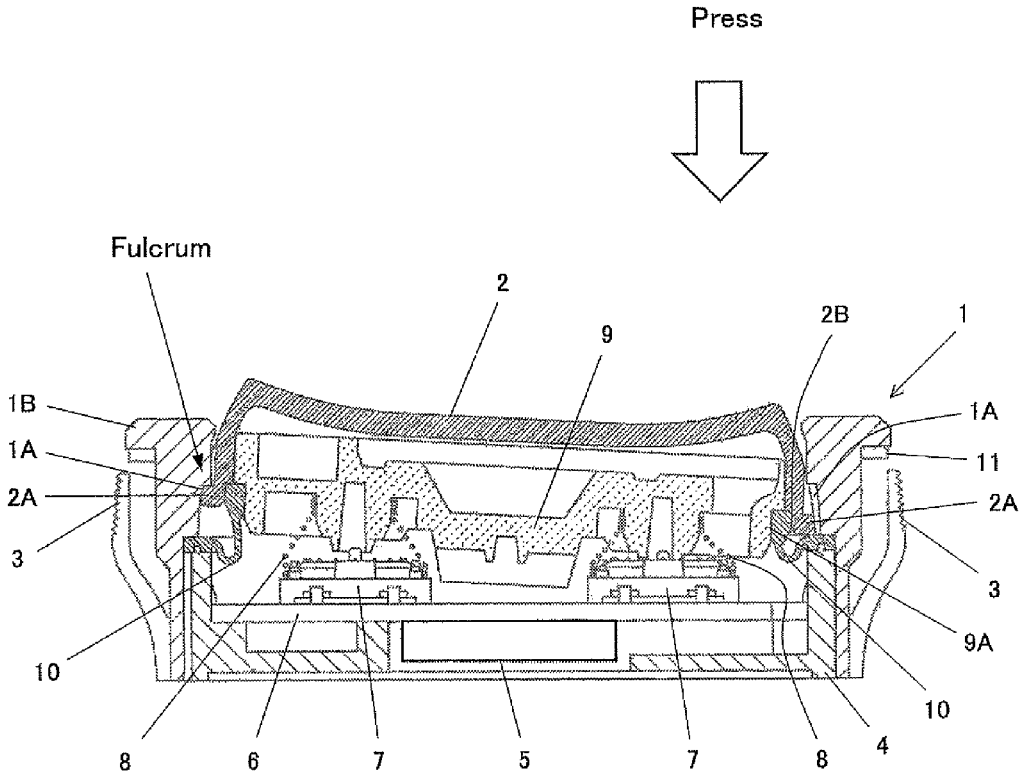
FIG. 9 is a cross-sectional view of the miniature switch illustrating the first embodiment of the present invention in the operating state.

FIG. 6 is an exploded perspective view of the miniature switch illustrating the first embodiment of the present invention, FIG. 7 is a cross-sectional view taken along the line A-A in FIG. 2, FIG. 8 is a cross-sectional view taken along the line B-B in FIG. 2, and FIG. 9 is a cross-sectional view of the miniature switch in the operating state.

In these figures, the case 4 is arranged below the housing 1 and accommodates a printed circuit board 6 having a connector 5 to be connected to an external device. Two switch elements 7 are arranged on the printed circuit board 6 for opening/closing contacts. A coil spring 8 is arranged on each of the switch elements 7. The upper portion of the coil spring 8 engages a protrusion formed on the underside of a holder 9 to retain the holder 9. The coil springs 8 keep pushing up the holder 9 while the switch is not operated, so that the switch elements 7 are in a non-operating state as shown in FIG. 7. On the other hand, upon selection operation of the switch, release of the operation of the operational button causes the switch mechanism unit to return instantaneously owing to the restoring force of a packing made of a resilient material and the coil spring.

The operational button 2 is fitted onto the holder 9 so as to cover it. A bottom protrusion 2A of the operational button 2 is arranged to engage with an inner step 1A of the housing 1. Also, a first packing 10 composed of a resilient member is arranged among the upper end of the case 4, an inner bottom end 2B of the operational button 2, and a side step 9A of the holder 9. The first packing 10 prevents water immersion into the switch while supporting the holder 9. Moreover, a second packing 11 for imparting the waterproof property is arranged on the underside of an outer flange 1B of the housing 1. The second packing 11 prevents water immersion from the surface of a panel (not shown). The switch is installed in the panel by disposing the second packing 11 to be sandwiched between the outer flange 1B of the housing 1 and the panel.

In this manner, the housing 1 of the miniature switch accommodates a switch operating unit composed of the holder 9 and the operational button 2, and a switch mechanism unit composed of the printed circuit board 6 having the switch elements 7, the coil springs 8, and the case 4.

When the right side of the operational button 2 of the miniature switch is pressed, as shown in FIG. 9, the bottom protrusion 2A on the left side of the operational button 2 comes in abutment with the inner step 1A of the housing 1 to serve as a fulcrum, causing the inner bottom end 2B on the right side of the operational button 2 to move downward. The holder 9 then tilts to the right, causing the switch element 7 on the right side to be pressed by the holder 9 to operate.

On the contrary, when the left side of the operational button 2 is pressed, the bottom protrusion 2A on the right side of the operational button 2 comes in abutment with the inner step 1A of the housing 1 to serve as a fulcrum, causing the inner bottom end 2B on the left side of the operational button 2 to move downward, so that the switch element 7 on the left side is pressed by the holder 9 to operate.

As described, this miniature switch allows the swinging motion of the operational button 2 without the need of a spindle for causing the swinging motion of the operational button 2 as has been provided in the conventional art. That is, the miniature switch herein is the switch capable of performing the swinging motion comprising the switch operating unit and the switch mechanism unit which operates by the operation of the switch operating unit, and can change a location of the fulcrum of the switch operating unit between the left end and the right end (opposing the pressed end) by the position to press the switch operating unit upon the operation. Therefore, the spindle for rotating the switch operating unit is not required.

Next, a second embodiment of the present invention will be described.

The miniature switch according to the second embodiment is similar in appearance to that of the first embodiment shown in FIGS. 1 to 5.

Figure 10:
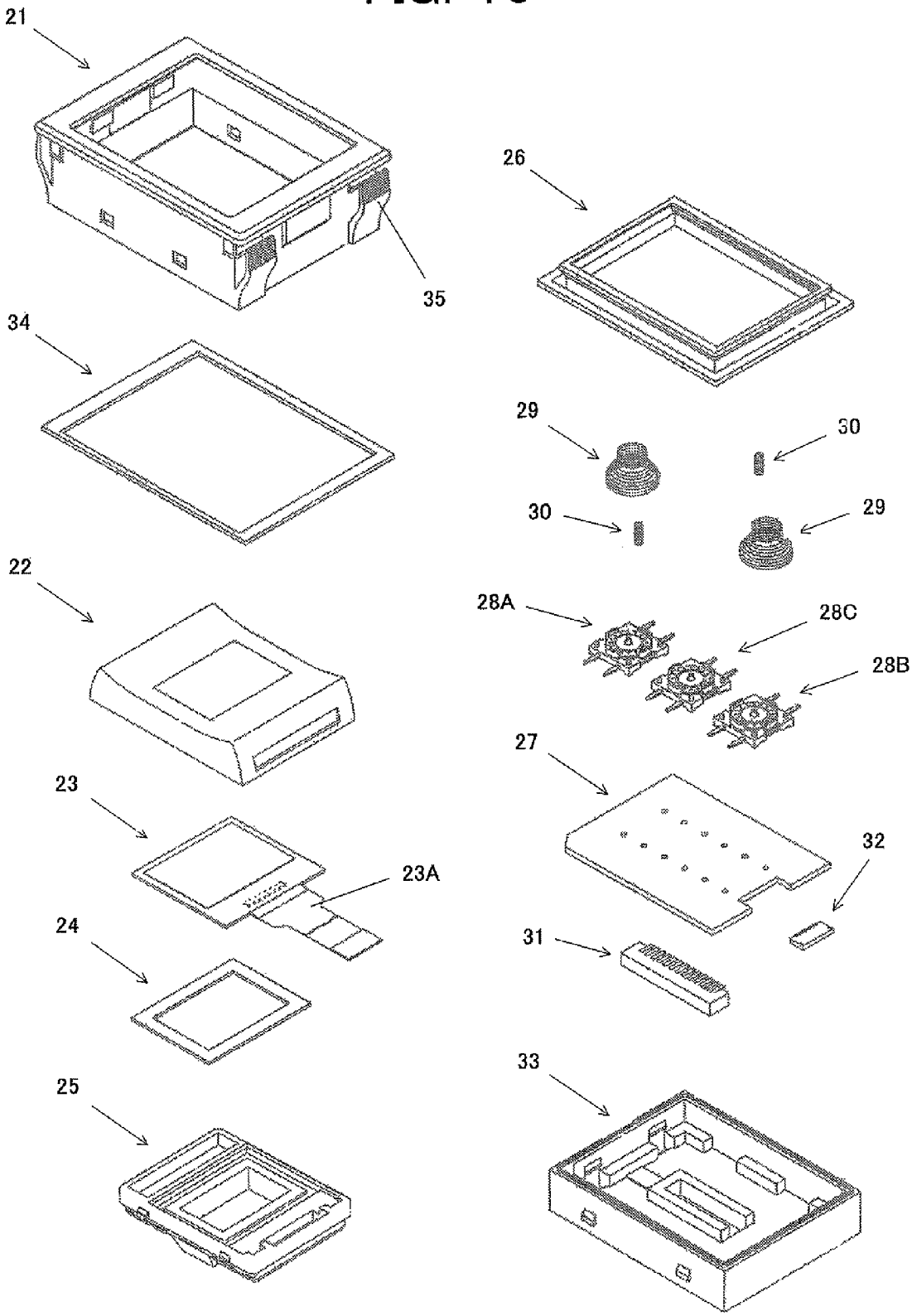
FIG. 10 is an exploded perspective view of the miniature switch illustrating a second embodiment of the present invention.
Figure 11:
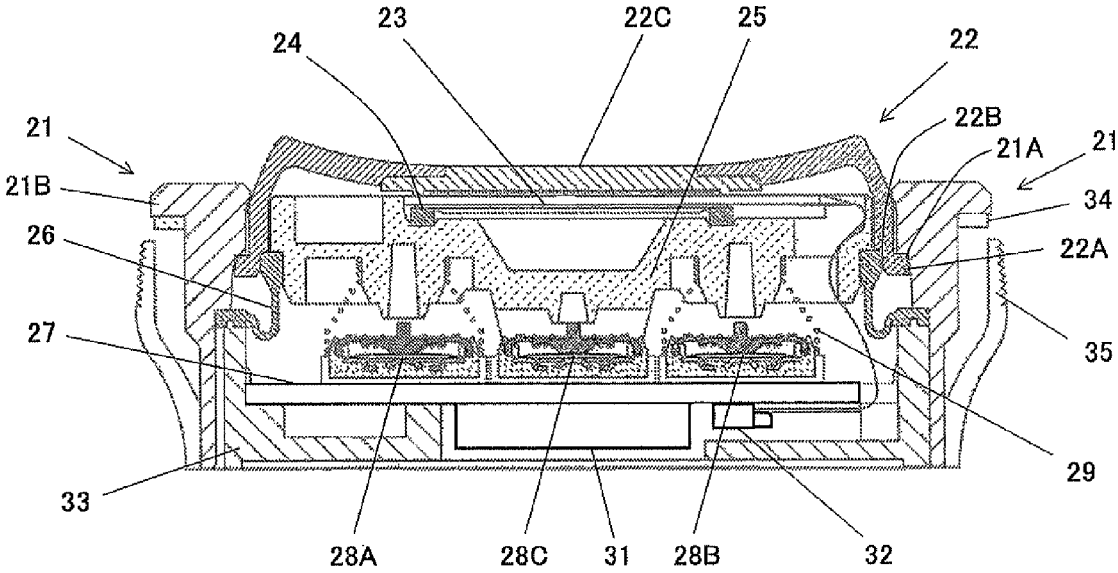
FIG. 11 is a cross-sectional view of the miniature switch illustrating the second embodiment of the present invention, taken along the line A-A in FIG. 2.
Figure 12:
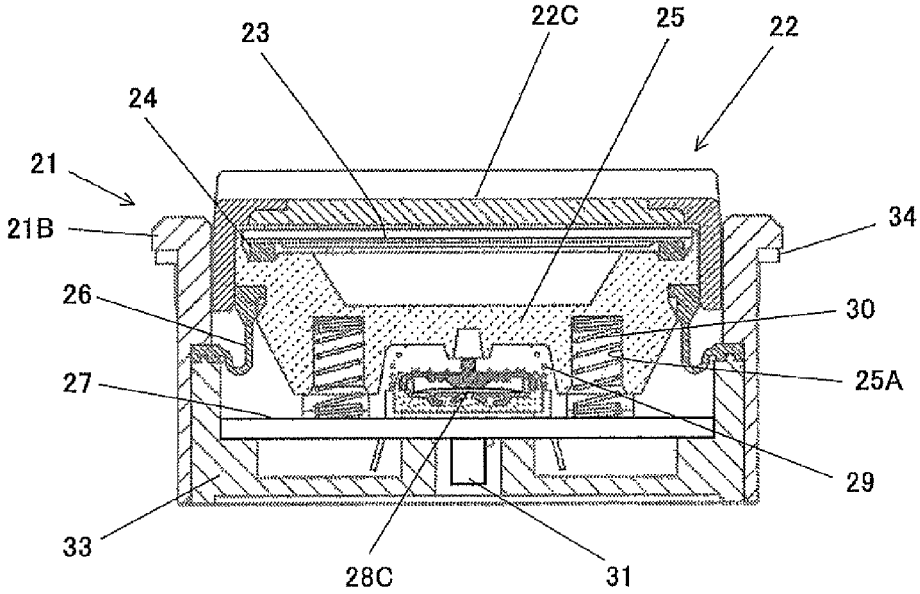
FIG. 12 is a cross-sectional view of the miniature switch illustrating the second embodiment of the present invention, taken along the line B-B in FIG. 2.
Figure 13:
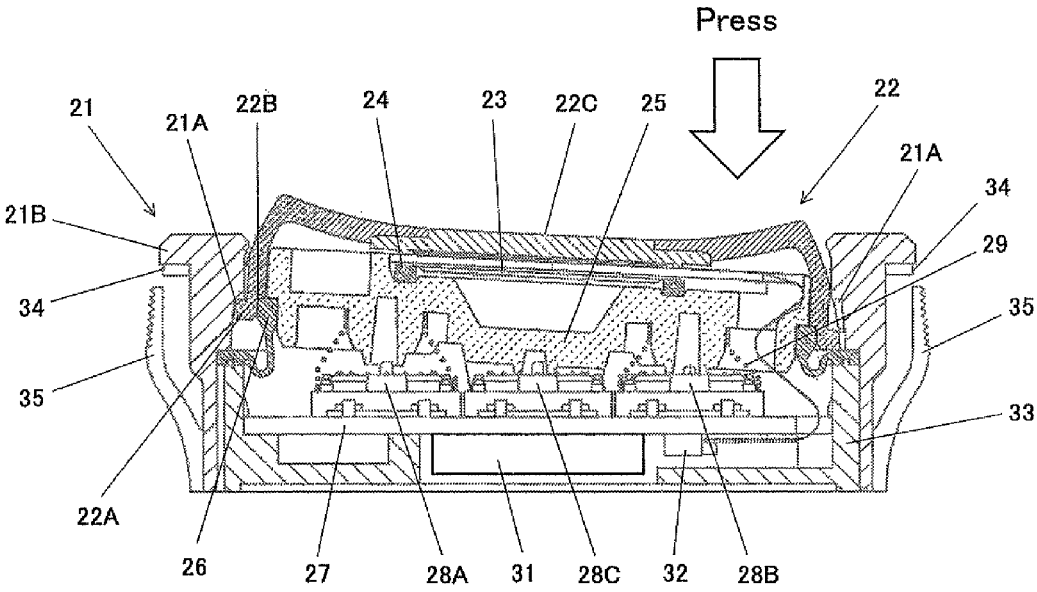
FIG. 13 is a cross-sectional view of the miniature switch illustrating the second embodiment of the present invention in the operating state.
Figure 13:
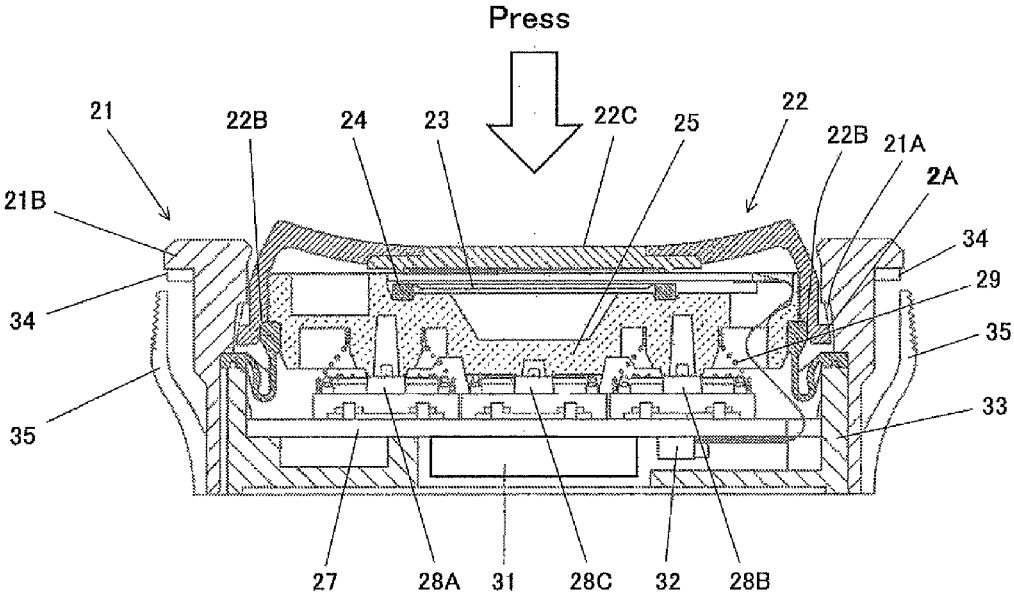

FIG. 10 is an exploded perspective view of the miniature switch illustrating the second embodiment of the present invention, FIG. 11 is a cross-sectional view thereof taken along the line A-A in FIG. 2, FIG. 12 is a cross-sectional view thereof taken along the line B-B in FIG. 2, and FIG. 13 is a cross-sectional view thereof in the operating state.

In these figures, reference numeral 21 denotes a housing, 22 an operational button, 22A a bottom protrusion of the operational button 22, 22B an inner bottom end of the operational button 22, 22C a display window, 23 an organic light-emitting display device (OLED) module, 24 a third packing, 25 a holder, 26 a first packing, 27 a printed circuit board, 28A and 28B left and right switch elements, respectively, 28C a central switch element, 29 a first coil spring, 30 a second coil spring, 31 a first connector, 32 a second connector, 33 a case, 34 a second packing, and 35 a leaf spring for fixing the switch.

The housing 21 accommodates the switch operating unit composed of the holder 25, the third packing 24, the OLED module 23, and the operational button 22, and the switch mechanism unit composed of the printed circuit board 27 having the connectors 31, 32 and the switch elements 28A to 28C, the coil springs 29, 30, and the case 33. The operational button 22 is fitted onto and adhered to the holder 25. The holder 25 is capable of pressing the switch element 28A, 28B, or 28C. The OLED module 23 for displaying texts, images, or the like is mounted on the top surface of the holder 25. The OLED module 23 is supported by the third packing 24, and fixed between the operational button 22 and the holder 25 via the third packing 24.

The first coil springs 29 are arranged between the switch elements 28 and the holder 25 to retain the holder 25, and serve to return the switch operating unit upon the selection operation performed by pressing the right or left side of the operational button 22. On the other hand, the second coil springs 30 are arranged between the printed circuit board 27 and underside pores 25A of the holder 25 to retain the holder 25, and serve to return the switch operating unit upon the determination operation performed by pressing the central portion of the operational button 22.

Mounted on the printed circuit board 27 are the left and right switch elements 28A and 28B, the central switch element 28C, the first connector 31, and the second connector 32. The first connector 31 is connected with an external device, while the second connector 32 connects a flexible cable 23A of the OLED module 23 to the printed circuit board 27.

Other features are similar to those of the first embodiment.

In this manner, according to the second embodiment, three switch elements 28A to 28C are arranged on the printed circuit board. The second embodiment is different from the first embodiment in that the left and right switch elements 28A and 28B are selectively operated by the swinging motion of the operational button 22, and the pressing of the central portion of the operational button 22 causes the operation of only the central switch element 28C. Also, the operational button 22 of the miniature switch according to the second embodiment has a more planar surface so as to be provided with a flat-type display device. In this embodiment, the OLED module 23 is arranged as the flat-type display device. The display device, however, is not limited to the OLED module 23, and a liquid crystal display device may be arranged instead. The display appears in a display window 22C made of a transparent member formed on the operational button 22, through which a user can view the light-emitting display.

Now, the operation of the switch will be described with reference to FIG. 13.

(1) First, when the right side of the operational button 22 is operated, as shown in FIG. 13(*a*), the bottom protrusion 22A on the left side of the operational button 22 comes in abutment with the inner step 21A of the housing 21 to serve as a fulcrum, causing the inner bottom end 22B on the right side of the operational button 22 to move downward, so that the switch element 28B on the right side operates by being pressed by the tilted holder 25. Although not illustrated, when the opposing left side of the operational button 22 is operated, the switch element 28A on the left side operates by being pressed by the tilted holder 25.

(2) When the central portion of the operational button 22 is operated, as shown in FIG. 13(*b*), the holder is pressed while keeping the horizontal state, so that only the central switch element 28C operates.

The miniature switch according to the second embodiment is suitable for the switch used for tree-type searching, in which the display is changed over for every operation, that includes the left and right switch elements 28A and 28B performing the selection operation and the central switch element 28C performing the determination operation.

In addition, release of the operation of the operational button can cause the switch mechanism unit to return instantaneously owing to the restoring force of the packing made of the resilient material and the coil spring.

The present invention should not be limited to the embodiments described above, and a number of variations are possible on the basis of the spirit of the present invention. These variations should not be excluded from the scope of the present invention.

According to the present invention, there can be provided a miniature switch capable of performing a swinging motion of a switch operating unit using the side opposing the pressed side as a fulcrum instead of providing a spindle in the switch operating unit.

In more detail, the present invention offers the following advantages:

(1) An operating stroke of an operational button can be extended.

(2) Swinging operation on both sides of the switch, not only on one side, is possible.

(3) Since the spindle of the operational button is not required, the switch can be provided with a pushing operation mechanism. Also, since there is no protrusion protruding from a switch mechanism unit, a waterproof structure can be readily configured. Moreover, since a display device and the pushing operation mechanism are provided, the display can be changed over by the swinging operation, and determination operation can be performed by pushing operation.

(4) Since switching operation and determination operation are possible, tree-type searching is enabled with a single unit of the switch.

(5) A first packing can retain a holder while preventing water immersion into the interior of the switch.

INDUSTRIAL APPLICABILITY

The miniature switch according to the present invention is applicable to the miniature switch capable of performing the swinging motion of the switch operating unit using the side opposing the pressed side as a fulcrum instead of providing the spindle in the switch operating unit.

What is claimed is:

1. A miniature switch comprising:

a switch operating unit including a holder and an operational button fixed to the holder, the operational button having bottom protrusions respectively located on left and right sides of the operational button;

a switch mechanism unit including a printed circuit board, a connector, and switch elements arranged in a case, and coil springs which engage between the switch elements and the holder; and three switch elements arranged on the printed circuit board, including two switch elements respectively arranged on left and right sides and operated by the swinging motion of the operational button, and a central switch element operated by pressing of a central portion of the operational button; and wherein the switch operating unit and the switch mechanism unit are coupled to each other by a packing made of a resilient material, and the switch mechanism unit and the switch operating unit are disposed in a housing; and wherein, by lowering the operated side of the operational button owing to the swinging motion of the operational button, a bottom protrusion of the operational button moves away from an inner step of the housing and descends along an inner surface of the housing, while the bottom protrusion of the operational button on the non-operated side of the operational button is supported by an inner step of the housing on the non-operated side of the operational button so as to serve as a fulcrum of the swinging motion of the operational button, and wherein, by operating the central portion of the operational button, the bottom protrusions on the left and right sides of the operational button move away from the inner steps of the housing and descend along the inner surface of the housing, such that only the central switch element is pressed down to operate.

2. The miniature switch according to claim 1, wherein release of the operation of the operational button causes the switch mechanism unit to return instantaneously.

3. The miniature switch according to claim 2, wherein a flat-type display device is arranged on a surface of the operational button.

4. The miniature switch according to claim 3, wherein the flat-type display device is an organic light-emitting device.

5. The miniature switch according to claim 3, wherein the flat-type display device is a liquid crystal display device.

6. The miniature switch according to claim 1, wherein a flat-type display device is arranged on a surface of the operational button.

7. The miniature switch according to claim 6, wherein the flat-type display device is an organic light-emitting device.

8. The miniature switch according to claim 6, wherein the flat-type display device is a liquid crystal display device.

* * * * *